United States Patent [19]

Tweedy, Jr. et al.

[11] 4,404,554

[45] Sep. 13, 1983

[54] VIDEO ADDRESS GENERATOR AND TIMER FOR CREATING A FLEXIBLE CRT DISPLAY

[75] Inventors: John F. Tweedy, Jr., Bellerose Villa; Morton B. Herman, Huntington, both of N.Y.

[73] Assignee: Standard Microsystems Corp., Hauppauge, N.Y.

[21] Appl. No.: 440,598

[22] Filed: Nov. 10, 1982

Related U.S. Application Data

[63] Continuation of Ser. No. 194,435, Oct. 6, 1980, abandoned.

[51] Int. Cl.[3] ..... G09G 1/16

[52] U.S. Cl. ..... 340/750; 340/726; 340/709; 340/801

[58] Field of Search ..... 340/750, 748, 744, 723, 340/726, 724, 801, 706; 364/515, 518, 521; 340/709, 706, 798

[56] References Cited

U.S. PATENT DOCUMENTS

| | | | |
|---|---|---|---|
| 3,426,344 | 2/1969 | Clark | 340/750 |
| 3,675,208 | 7/1972 | Bard | 340/750 |
| 3,715,744 | 2/1973 | Ito et al. | 340/801 |
| 4,121,283 | 10/1978 | Walker | 340/706 |
| 4,189,727 | 2/1980 | Vaughn, Jr. | 340/750 |
| 4,199,815 | 4/1980 | Kyte et al. | 340/750 |
| 4,200,869 | 4/1980 | Murayama | 340/709 |
| 4,249,172 | 2/1981 | Watkins et al. | 340/750 |
| 4,284,989 | 8/1981 | Parsons | 340/750 |

*Primary Examiner*—Marshall M. Curtis

*Attorney, Agent, or Firm*—Hopgood, Calimafde, Kalil, Blaustein & Judlowe

[57] ABSTRACT

A microprocessor based CRT video display system includes a microprocessor, a memory and a video processor and controller. The video processor and controller incorporates data and address bus structure in which a plurality of programmable registers are connected to both the data bus and the address bus. The programmable registers arranged along the data and address buses permit efficient retrieval of information from memory for display and also permit the video display system to provide a number of advantageous system features.

9 Claims, 8 Drawing Figures

VIDEO ADDRESS GENERATOR AND TIMER FOR CREATING A FLEXIBLE CRT DISPLAY

This is a continuation of Ser. No. 194,435 filed Oct. 6, 1980, which is to be abandoned.

FIELD OF THE INVENTION

This invention relates to video display terminals and more particularly to a video processor and controller for use with microprocessor based CRT video display systems.

BACKGROUND OF THE INVENTION

Video terminals of various configurations are well known and widely used. Since the introduction of the microprocessor video terminals have become "intelligent"; that is video terminals no longer rely entirely on a remote processor to provide data entry, data handling and terminal features such as underline, blinking underline, reverse video, split screen, etc.

Early video terminal systems required at least 100 Medium Scale Integration (MSI) and Small Scale Integration (SSI) devices to implement a relatively small number of terminal features. An example of one early terminal is the Lear-Seigler ADM-3. Second generation video terminal display systems began using a microprocessor in conjunction with Large Scale Integration (LSI) video controllers which provided many necessary functions, such as sync timing and memory addressing, previously done in MSI and SSI. An example of such a second generation video controller is the SMC CRT 5027 provided by Standard Microsystems Corporation of Hauppauge, New York. The use of a microprocessor in conjunction with an LSI video controller also provided a means whereby "intelligent" features such as character and line editing and other word processing features could be incorporated into the display system. Second generation display systems however continue to experience many unsolved problems. These problems include:

Memory Contention:

The microprocessor and the video controller in a video display system must both access the same system memory which is used to store data prior to display. The video controller must access memory constantly in order to refresh the screen; the microprocessor must access memory in order to update or modify memory locations for displaying information on the screen. At times both the microprocessor and the video controller simultaneously request access to the memory. The solution to the memory contention problem must assure screen display integrity and continuity while at the same time permit rapid access to memory. Previous video controllers have been inefficient in their approach to memory contention by permitting microprocessor updates only during vertical or horizontal retrace, which restricts the rate of data entry to the system, or by requiring a large amount of external circuitry to achieve reasonable microprocessor throughput. Prior video controllers also have few memory contention schemes available, thus limiting system design flexibility.

Ease and Flexibility of Hardware and Software Implementation

Previous video controllers have primarily used the sequential method of memory access for refreshing the display. This requires that all data to be displayed reside in consecutive memory locations. With this method, in order to do a screen edit operation, such as line delete, an average of ½ the entire screen data must be moved in memory. This burdens the microprocessor and effectively reduces throughput.

In addition it is sometimes desirable to display rows of status data, which inform the operator of special status conditions in the system, while simultaneously rolling non-status rows off the screen as new data is being put into memory (e.g. from a communications buffer). Previous video controllers have required difficult and time consuming software and/or additional hardware to perform these functions.

Vertical Split Screen

In previous designs it has been difficult to implement a vertical split screen, that is, a display in which there may be two or more independent columns. One example of this application is a dual language CRT screen where the left hand side would indicate one language, such as English and the right hand side might indicate another language, perhaps French. In these applications it is desirable to be able to independently modify each side of the screen. Up to now this had been difficult since, for present video controllers, the entire screen must be manipulated in order to change one portion of the screen.

Smooth Scroll

Present controllers do not effectively support smooth scroll operations. Smooth scroll is the ability to scroll (move) the display up or down by as little as one raster scan line per frame. Certain applications also require the ability to smooth scroll a partial section of the display page. In order to implement these smooth scroll features with present video controllers, much additional hardware is required thereby increasing the cost of the total system.

Attribute Handling

At the present time character attributes are basically of two types, either embedded or invisible. "Embedded attributes" is a method of generating attributes by inserting (embedding) attribute characters within the display character stream. A display space on the screen is taken up for every change of attribute and the new attribute is effective until the next change of attribute occurs. With embedded attributes it is impossible to handle attributes such as color, blinking, reverse video, or underline on a character to character basis. Invisible attributes do not take up display space but instead the bit width of each character in memory is widened to accommodate a bit for each independent attribute. Thus, in order to accommodate three attributes, the character memory itself must be widened by three bits. This creates extensive microprocessor overhead especially when using a standard eight bit microprocessor system.

Double Height/Double Width Rows

Present video controllers do not support double width and double height character rows or smooth scrolling of these type rows. Extensive and costly hardware and software is required to implement these features.

It is therefore an object of the present invention to provide a video controller capable of solving the problems present in prior art video controllers without the need for increased complexity in both hardware and software.

It is a further object of the present invention to provide a video display system in which terminal features, not available in prior art systems, can be readily implemented.

SUMMARY OF THE INVENTION

In accordance with the invention a CRT video display system includes a microprocessor, a memory a video processor and controller, a data bus coupling the video processor and controller to the microprocessor and memory and an address bus coupling the video processor and controller to the microprocessor and memory.

It is a feature of the invention that the video processor and controller comprises a plurality of programmable storage registers, a first portion of the register plurality being connected to the data bus and a second portion of the register plurality being connected both to the data bus and the address bus.

It is another feature of the invention that each of the storage registers is programmable by the microprocessor to store selected address and control characters.

It is a further feature of the invention that the video processor and controller accesses the storage registers via the address bus and the data bus and utilizes the characters stored therein to retrieve selected information from memory for display on the CRT in the video display system.

In accordance with another aspect of the invention the video display system includes a character generator for displaying characters on the CRT and a data buffer connected between the memory and the character generator.

It is a still further feature of the invention that the video processor and controller retrieves information from memory, stores the information in the data buffer and applies this information to the character generator without requiring further memory access by the video processor and controller.

The foregoing and other objects and features of this invention will be more fully understood from the following description of an illustrative embodiment thereof in conjunction with the accompanying drawings.

DETAILED DESCRIPTION

Figure 1:
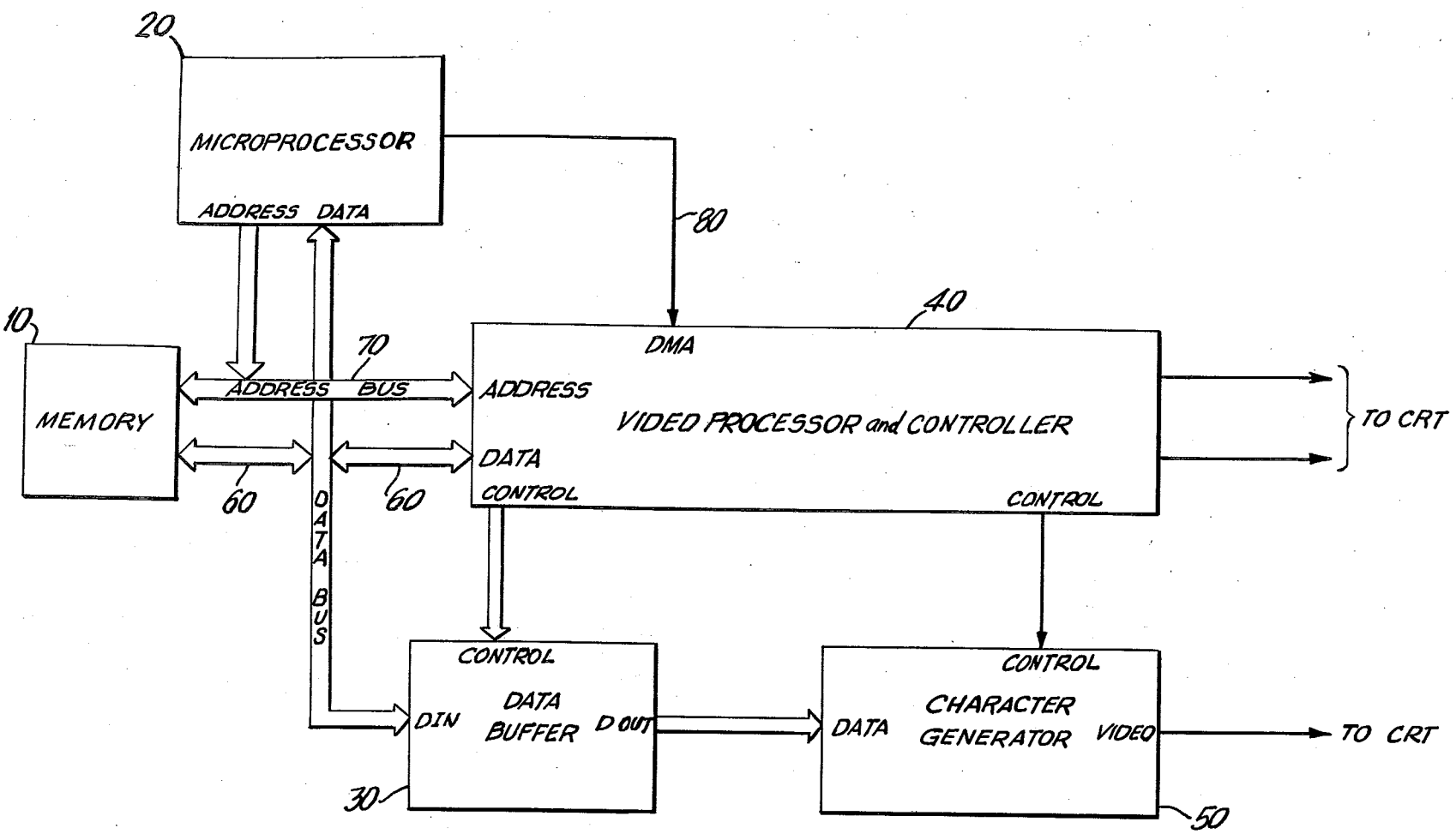
FIG. 1 illustrates a block diagram of a microprocessor based CRT video display system.

Refer to FIG. 1, wherein there is shown a block diagram of a microprocessor based CRT video display system in accordance with the instant invention. Information to be displayed on a CRT (not shown) is stored in Video Memory 10 which is a commercially-available semiconductor Random Access Memory (RAM). The RAM can be accessed by microprocessor 20 or by Video Processor and Controller 40. Information may be stored in memory 10 via a local keyboard (not shown) or by a remote data source. Data flow into and out of memory 10 is controlled by controller 40 via address bus 70 and data bus 60. Microprocessor 20 performs data control and management functions for the video terminal which are not part of the instant invention.

Data buffer 30 is an interface between memory 10 and character generator 50 and is controlled by controller. The data buffer performs a variety of functions as will be detailed hereinafter but basically functions to temporarily store data from the memory while simultaneously transmitting previously received data to the character generator. The data buffer allows information to be received from memory at a rate slower that the rate necessary to supply data to the character generator and the CRT.

The function of character generator 50 is to translate data stored in the video memory into characters for display on the CRT. This process is performed under the control of controller 40. A CRT must be constantly refreshed to produce a stable video presentation. Therefore the controller must continually address the video RAM and continually direct data from the RAM, to the data buffer and from there to the character generator to ensure screen refresh. Character generators are well known in the art and a typical character generator is the CRT 8002 provided by Standard Microsystems Corporation of Hauppauge, New York.

The heart of the system is the controller. This device provides all of the necessary timing signals, such as vertical sync, horizontal sync, and blanking necessary to control the CRT. In addition, the controller advantageously solves the problems inherent in prior art video controllers and provides sophisticated video features, each of which is considered below.

Memory Contention

The controller of the instant invention handles memory contention in several different ways. One of these is through use of the external data buffer 30 shown in FIG. 1. At the first scan line of each new data row, controller 40 requests Direct Memory Access (DMA) to microprocessor 20 via the DMA bus 80. The microprocessor must grant this DMA request prior to the start of active video, usually within several microseconds. When the microprocessor grant occurs video addresses are presented to memory 10 by the controller during the first scan line of the data row. As these addresses are presented to memory at the display character rate the characters read out from memory are outputted to data buffer 30 and simultaneously to character generator 50. At the end of the first scan line in the data row all the data has been written into the data buffer. The controller will then drop the DMA request line to the microprocessor thereby permitting the microprocessor to access memory for other operations.

For the remaining N−1 scan lines where N is the total number of scan lines per data row, the screen refresh data will be read out of the data buffer without additional access to memory. This permits unrestricted memory access for N−1 scan lines of the total N scan lines per data row. For a typical display with 12 scan lines per data row this means that the controller is accessing memory for only 8% of the total memory cycle time available, and the microprocessor has the remaining 92% of the memory cycle. This yields high bus bandwidth utilization, high throughput for the microprocessor and low system loading by the controller.

This method of resolving memory contention is satisfactory for many applications. However, in certain system applications it is undesirable to lock out the microprocessor from memory for as long as one scan line (typically 50 to 60 microseconds). This type of condition may occur in a situation where the microprocessor is servicing some high-speed peripheral such as a floppy disk which may require access to memory for reading or writing data as often as one byte every 14 microseconds. In this situation, a second method of resolving memory contention is provided by the controller. This second method is accomplished by software programming the controller with the microprocessor to operate with an external double row buffer (not shown). A double row buffer is substantially the same as buffer 30 but is capable of storing two rows of data. With a double row buffer, the first data row is loaded into the buffer during the vertical retrace interval then, while the first data row is being displayed, the second data row is loaded into the other half of the double row buffer. This provides the controller with a total of N scan lines (N=# of scan lines per data row) in which to load the data row contents into the second half of the double row buffer. The controller may be programmed to a burst and delay DMA mode such that the DMA request signal will request only M cycles where M is a programmable number and then go inactive for P cycles where P is also a programmable number to allow some other device to take over the bus and memory during the P interval. A typical example of this might be a DMA burst of a 16 character cycles followed by a DMA delay of 8 cycles before the next burst of 16 cycles. A system operating at a 500 nanosecond character rate would then permit an external access from a device, such as a floppy disk, as often as once every 8 microseconds. Since DMA cycles are occurring in burst rather than continuously, loading the data row in the buffer will require more than one scan line. However since operation is now with a double row buffer, the controller has up to N scan lines to complete loading.

In addition to the single and double row data buffer contention resolution schemes described above, it is also possible to run the controller with no buffer at all. In this mode, controller 40 presents its addresses to memory every scan line. However the microprocessor may intervene to read and write directly from memory and therefore a user must exercise caution when a buffer is not used. Although eliminating the buffer saves hardware, this method limits system throughput unless additional hardware is used, such as a multiple phase memory, or unless occasional screen flashing or loss of video is an acceptable mode of operation. Screen flashing or loss of video will occur since whenever the microprocessor accesses memory, at the same time the controller wishes to access memory, a momentary screen refresh failure will occur if the microprocessor is given priority. One other method to limit screen refresh interruption when the no buffer configuration is used would be to restrict microprocessor access to memory (by using external hardware) to only those times the controller is not accessing memory, that is, during horizontal and vertical synchronization intervals. This method, however, also decreases throughput.

Flexible Hardware and Software Addressing Schemes

The controller provides the addresses to memory 10 which cause the display data to be read out from memory in order to refresh the screen. Several methods of memory addressing are implemented which provide a substantial amount of flexibility in both hardware and software for the system designer. These methods include a sequential addressing mode and a row address mode.

Figure 2:
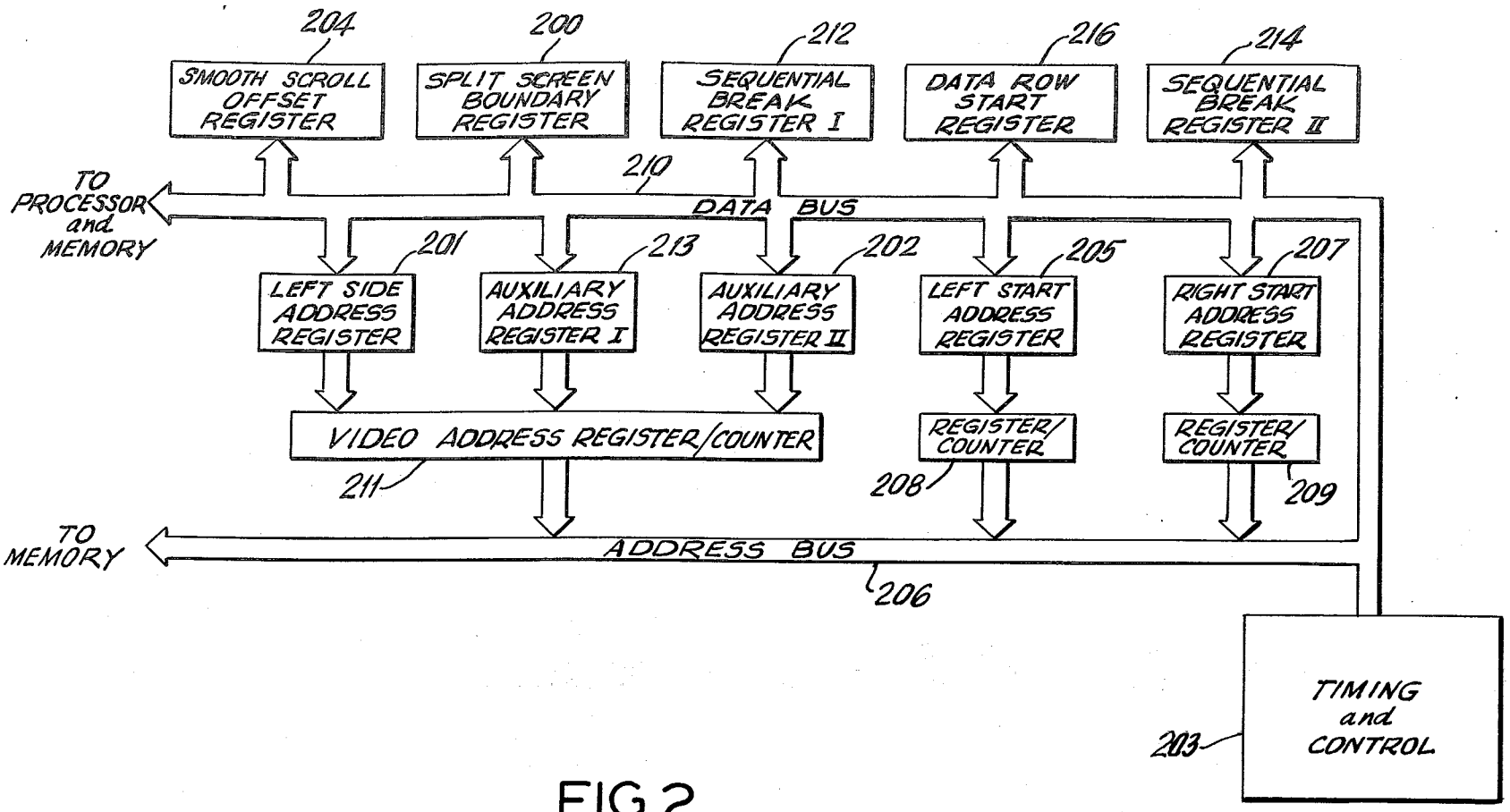
FIG. 2 illustrates a block diagram of the video processor and controller of the instant invention.

FIG. 2 illustrates the internal bus and register design of the controller. A plurality of user programmable registers 201,202, etc. are designed to store certain control and address information described hereinafter in more detail. Each register may be preset to a particular state by the microprocessor when properly programmed by the terminal user. The registers are advantageously arranged such that they are accessible from data bus 210 or address bus 206. Timing and control for the controller is represented by circuit 203 but as such circuitry is not part of the present invention further details are not provided.

Figure 3:
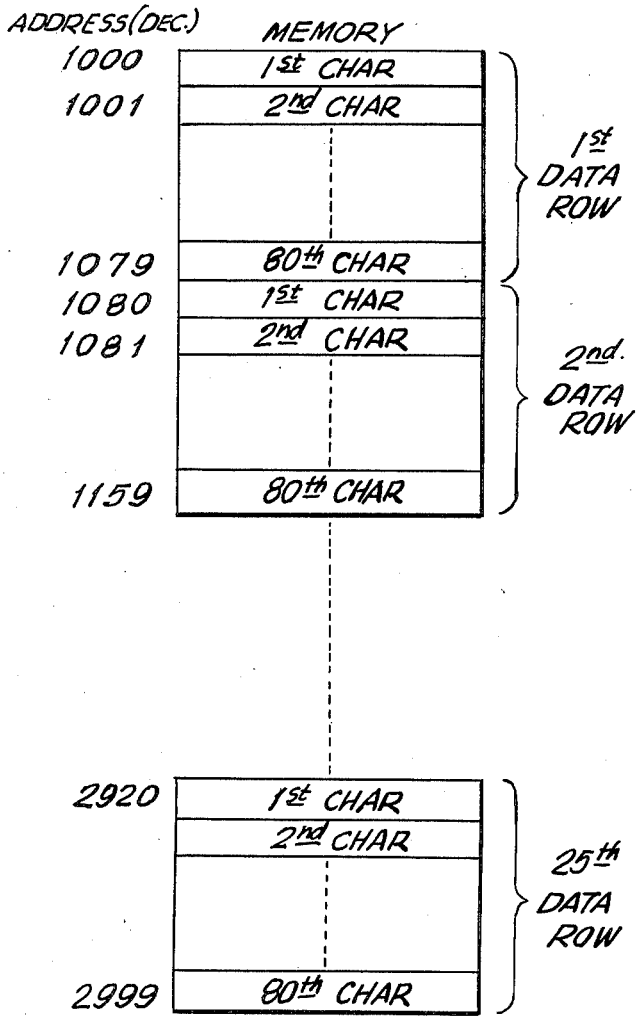
FIG. 3 illustrates a sequential memory addressing scheme in accordance with the instant invention.

Considering now the sequential video addressing mode, a left Start Address register 205 is programmed to contain the address in memory of the first character of the first data row on the screen. When operating in the sequential mode characters are read sequentially from memory starting with the character at the address provided in register 205. If, for example, the display is an 80 character by 25 row display there will be 2,000 characters on the screen. If the address in register 205 is 1,000, the address of the last character in the last row will be 2,999; that is, characters will take up successive locations in memory. FIG. 3 illustrates sequential memory addressing. The address in register 205 is applied to the memory via address bus 206 and in response thereto data words are retrieved from memory, applied to the character generator and displayed. Register/counter 208 serves to increment the address stored in register 205 each time data is received from memory to accomplish sequential retrieval from the consecutive memory locations.

Start Address register 205, along with a second register 213, called the Auxiliary Address Register I, plus a third register 212 called the Sequential Break Register I, are used so that display memory addressing may be offset or "rolled" to permit new data being received into the memory, such as from a communications line, to be entered at the bottom of the screen and old data to be rolled off at the top of the screen. To accomplish this, the Auxiliary Address Register I is set to the address of the beginning of memory, that is to the beginning of screen memory, where incoming information is being stored, and register 205 is set to the address of the beginning of the line which is to be displayed at the top of the display page. Sequential Break Register I causes address control to be switched from the register 205 to Auxiliary Address Register I at the line designated in Sequential Break Register I, Thus on a 24 row display, to roll the display by one line, Sequential Break Register I should be set to 23 and register 205 should be set to the address that normally corresponds to the second displayed data row.

In this mode, when address control resides in register 205, the address is incremented by register/counter 209 as previously described to accomplish sequential access to the memory. When address control is transferred to Auxiliary Address Register I, the address stored in this memory is incremented by register/counter 211 in the same manner that register 208 increments the memory address. Addresses are transferred to the memory via address bus 206 and control is returned to register 205 when a new display page is started.

One further enhancement to the sequential mode of operation is possible. In addition to the rolling operation, described above, a status row may be held constant at the bottom of the screen or at the top of the screen while the other rows are being rolled. This may be accomplished by the use of a register 202 called the Auxiliary Address Register II, and a register 214 called the Sequential Break Register II. By setting the Sequential Break Register II to the last data row number (for example, 24 in a 25 data row display) and by setting Auxiliary Address Register II to the location in memory which corresponds to the data to be displayed in the status row, address control will be transferred to Auxiliary Address Register II when the last data row is to be displayed. This will cause the status row to be read out and inserted into the last data row position on the screen. The sequential mode of operation of VPAC as described above, provides the user of low-to-medium-end systems with an enhanced method of implementing sequential data display, yet a method which is relatively easy to implement in both software and hardware.

Figure 4:
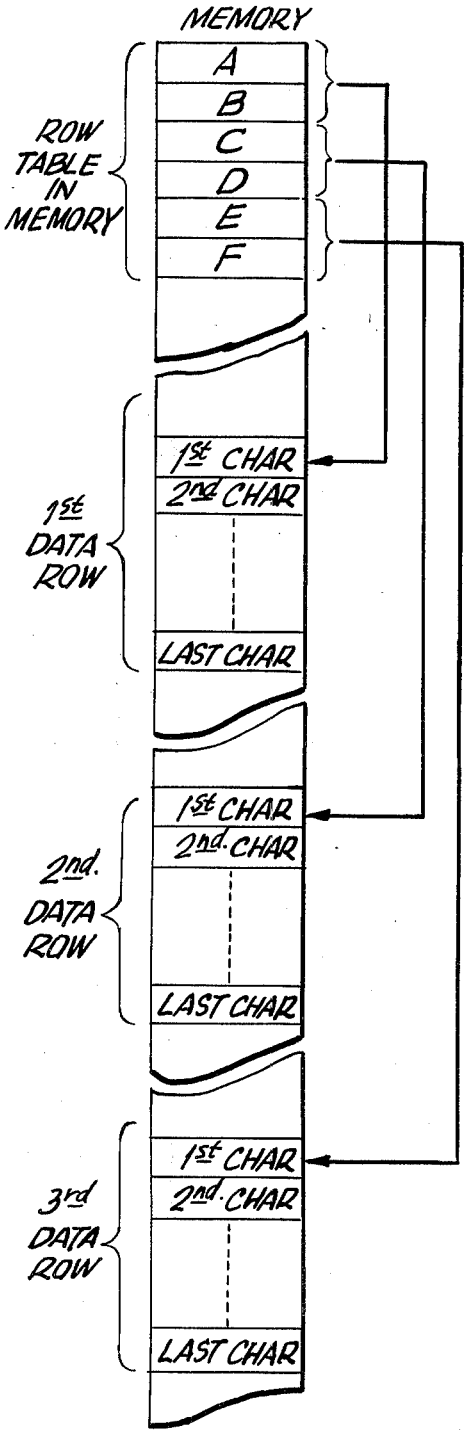
FIGS. 4 and 5 illustrate row table addressing schemes in accordance with the instant invention.

In the row table driven video addressing mode, each data row for video display is designated by its own address. This provides the user with much greater flexibility than sequential addressing since the rows of characters are linked by pointers instead of residing in sequential memory locations. Operations such as data row insertion, deletion, and replication are easily accomplished by manipulating pointers instead of entire lines. The row table can be stored in memory in a contiguous format or in linked lists. These two formats are described below and shown in FIGS. 4 and 5, respectively.

In the row table driven mode each data row on the screen has its own starting address and a row table exists in memory which contains the starting address for each data row. For a screen with 24 data rows, for example, the row table will consist of 24, 14-bit addresses each pointing to the first character position of its respective data row. In the contiguous row table format shown in FIG. 4, row table addresses are stored in contiguous, that is, sequential memory locations and the user programs Start Address Register 205 with the starting address of the contiguous row table.

When the controller is ready to start displaying a new data row the address in register 205 is applied to the memory via address bus 206 and the first half of the first row address (Address A in FIG. 4) is retrieved and stored in register 201 via data bus 210. The second half of the first row address (Address B in FIG. 3) is retrieved next and also stored in register 201 via data bus 210. The complete first row address is then applied to the video memory via video address register/counter 211 and address bus 206 and in response thereto the first character of the first data row (See FIG. 4) is retrieved from memory and displayed. Register/counter 211 increments this address to sequentially retrieve from memory all of the 80 characters in the first data row. When the first data row has been displayed, the starting address for the second data row is retrieved, stored in register 201 and the process just described is repeated to display the second data row. The remaining data rows on the screen are displayed in the same manner.

Many advantages result from using the row table driven mode of operation. For example in order to erase a data row all the software designer has to do is change the row table pointer in memory for that particular data row and make it point to a data row in memory that has been cleared. To effect a clear of the entire screen a single data row in memory may be pointed to by each row address in the row table. Or, for example, a new line may be inserted on the screen and the bottom dropped off the screen by moving all the row pointers following the row to be inserted down one row in memory and inserting the new row pointer in the space opened up in the row table. Thus, with this mode of operation, to clear the screen it is not necessary to move an entire screen of data but only manipulate the row table itself.

Figure 5:
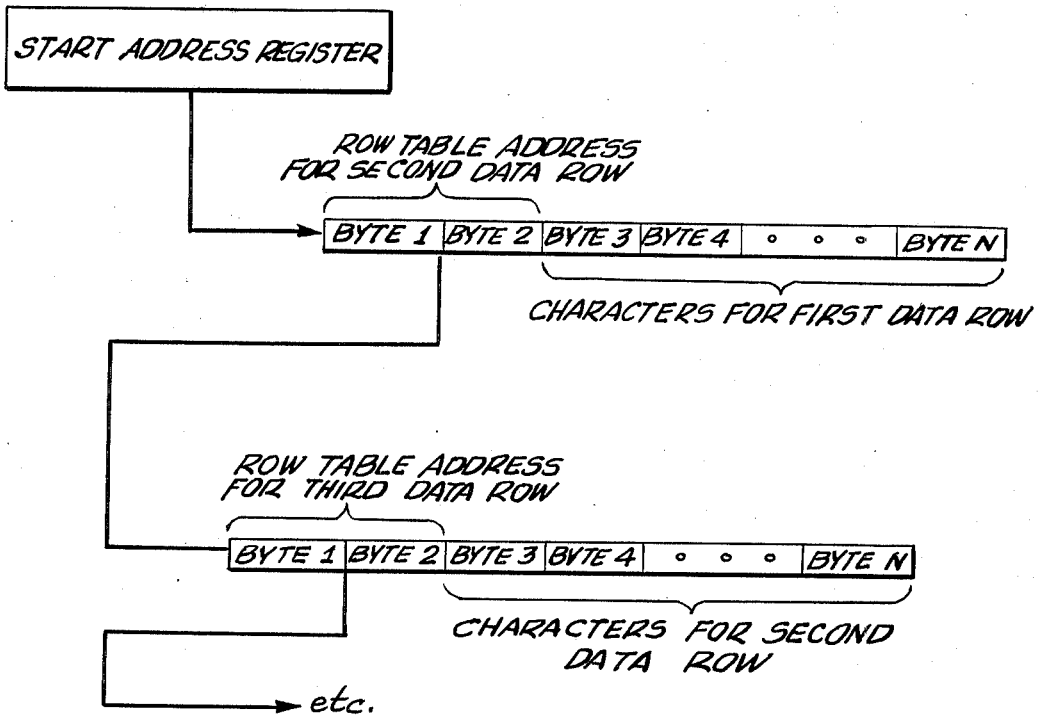

In the linked list row table format illustrated in FIG. 5, start address register 205 defines the memory address which starts the entire addressing scheme in operation. Prior to the start of the first data row display on the screen this address is loaded by the timing and control logic 203 into the left side address register 201. At the beginning of the first data row the address contained in register 201 is loaded into video address register/counter 211 and the contents of video address register/counter 211 are output to memory 10 via address bus 206 to retrieve the low order byte of the address for the next (i.e. 2nd) data row in memory. The video address register/counter 211 is then incremented (by 1) and its new contents are then output to memory 10 to retrieve the high order byte of the address for the next (i.e. 2nd) data row in memory. As these two bytes are retrieved they are loaded into the left side address register 201 where they are temporarily stored until it is time to retrieve the display characters for the next (i.e.2nd) data row.

At this point the contents of video address register/counter 211 are again incremented (by 1) to retrieve the first display character from memory. After the first character has been retrieved the remainder of the display characters on the first row are similarly retrieved. After all the characters for the first data row have been retrieved, the timing and control logic 203 causes the address that was temporarily stored in the left side address register 201 to be loaded into video address register/counter 211. The sequence now repeats until all the data rows on the screen have been displayed.

As illustrated in FIG. 5, each succeeding data row contains the starting address of the next data row. In many types of system organization, this method of memory addressing provides for simple software implementation, since, for example, to insert a data row, only the row table address for the row above the row to be inserted and the row to be inserted itself must be manipulated (4 bytes total). No other row table addresses have to be changed since they are already associated with data to be displayed. This is different from the contiguous row table method which requires on the average that one-half the row table be changed for each row insertion. Thus the linked list row table method reduces system software overhead for systems in which row insertion and deletion are frequent operations.

For both the contiguous row table and the linked list row table formats, a further enhancement is possible and that is by using Sequential Break Register I and Auxiliary Address Register I a status row or rows may be defined at the top or bottom of the screen. For example, on a 25 data row display by putting Sequential Bank Register I at 21, address control will be switched to Auxiliary Address Register I on the twenty-second data row. All data rows then following the twenty-first data row will be addressed sequentially by means of Auxiliary Address Register I. This enhancement permits fast software context switching and display. It is especially useful when data to a display or terminal from a high speed high priority source must be immediately displayed on the screen.

Vertical Split Screen Operation

Vertical split screen operation segments the screen into several separate vertical columns of information. The simplest of these is a single split down the middle of the screen with the same number of characters on either side of the screen. Split screen operation could be performed entirely with software by manipulating all the contents of the screen whenever an update to either section of the split screen was desired. However, in order to accomplish split screen efficiently with a minimum of software complexity and with maximum system throughput a hardware solution is essential. A simple two part split screen, useful for such operations as side by side language translation and newspaper columns, may be defined by a Split Screen Boundary Register 200, by Right Start Address Register 207 and Left Start Address Register 205, shown in FIG. 2. In operation, the Split Screen Boundary Register defines the character location at which the split is to occur. For example, on an 80 character wide screen the characters are numbered from 0 to 79. If the Split Screen Boundary Register is set to 40, transfer of control from Left Start Address Register 205 to Right Start Address Register 207 will occur at the 40th character. This permits separate data operations to be performed on the left hand side of the screen and the right hand side of the screen without changing the data on the entire screen. By the inclusion of sufficient left and right auxiliary address registers and left and right break registers the split screen operations can be treated as two separate data entities that is, as two separate screens. Register/counter 209 functions in the same manner as register/counter 208 in incrementing the address stored in register 207 when control has been passed to the Right Start Address Register.

The number of vertically split screens or columns which may be implemented is limited only by the number of registers in the implementation. For example, four vertical splits can be defined by including three split screen boundary registers. As each new data row boundary is encountered transfer of address control is transferred from one Start Address Register to another Start Address Register. There must of course be Auxiliary Address Registers associated with each new split screen section.

Smooth Scroll Operation

In order to provide good human interface with a CRT system it is often desirable to have previously displayed data roll smoothly off the top of the screen while new data smoothly comes onto the bottom of the screen. This is in contrast to a "jump" scroll method whereby the entire line enters instantaneously from the bottom of the screen and an entire line is jumped off the top of the screen. Smooth scroll requires that data be rolled off the screen on a scan line by scan line basis. The rate at which data is rolled off the screen, and its relative smoothness, can be adjusted by varying the number of scan lines per frame that are rolled off the screen. In addition to smooth scroll operation over the entire screen the area of smooth scroll may be limited to a particular location on the screen. That is, a partial page smooth scroll may be defined such that the rows above and below the smooth scroll area remain constant while the data rows in the smooth scroll area continue to scroll.

Two user programmable registers permit the user to define the start data row and the end data row for the smooth scroll operation as shown in FIG. 2. Data Row Start Register 216 is used to define the start data rows while Sequential Break Register II is used to define the end data row. Program intervention is required each frame. The VPAC sets an interrupt during the vertical retrace interval which requests service from the microprocessor. The microprocessor in response loads Smooth Scroll Offset Register 204 with the scan line number indicating the initial scan line affect of the first data row of the smooth scroll area.

A smooth scroll rate of one scan line per frame may be implemented by programming register 204 with an offset of zero in the first frame, one in the second frame, two in the third frame and so forth until N scan lines have been offset where N is the number of scan lines per data row. At this point an entire data row will have been scrolled off the smooth scroll area and the row table must then be manipulated to move each of the remaining data rows up one position. The Smooth Scroll Offset Register is returned to zero and the sequence may be repeated if it is desired to scroll off additional lines of data.

By decrementing the Smooth Scroll Offset Register instead of incrementing it, a smooth scroll in the downward direction on a screen may be accomplished. Since a smooth scroll can momentarily result in a partial data row consisting of one scan line, the loading of data buffer 30 (FIG. 1) for the start and end data rows during a smooth scroll operation is forced to occur in one scan line. This condition overrides the programmable DMA burst/delay requests described above.

Attribute Assemble Modes

In order to produce video attributes such as reverse video, blink, underline, strike-through, and modes which must change a character-by-character basis, it is necessary in the prior art to append one bit for each independent attribute to each character that is to be displayed. Ordinarily, this requires the use of a video memory whose bit width is equal to the number of bits required for each character. For example, to display an ASCII character with the attributes of blinking, reverse video, underline, and one of two colors requires 11 bits per character. There are seven bits to define the character and four more bits appended for the four independent attributes for a total of eleven bits. If a typical eight bit microprocessor is used for the display systems, loading and manipulating a memory size greater than 8 bits in cumbersome and may require additional hardware. The attribute assemble modes of the controller solve this problem by permitting storage of both data and attributes in an 8 bit memory and assembling attributes together with the character just prior to data display.

Figure 6:
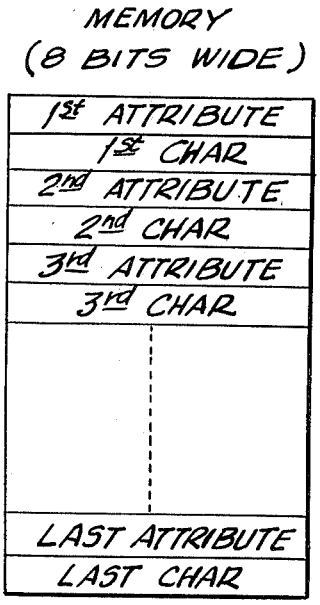
FIGS. 6 and 7 illustrate attribute assembly storage in accordance with the instant invention.
Figure 8:
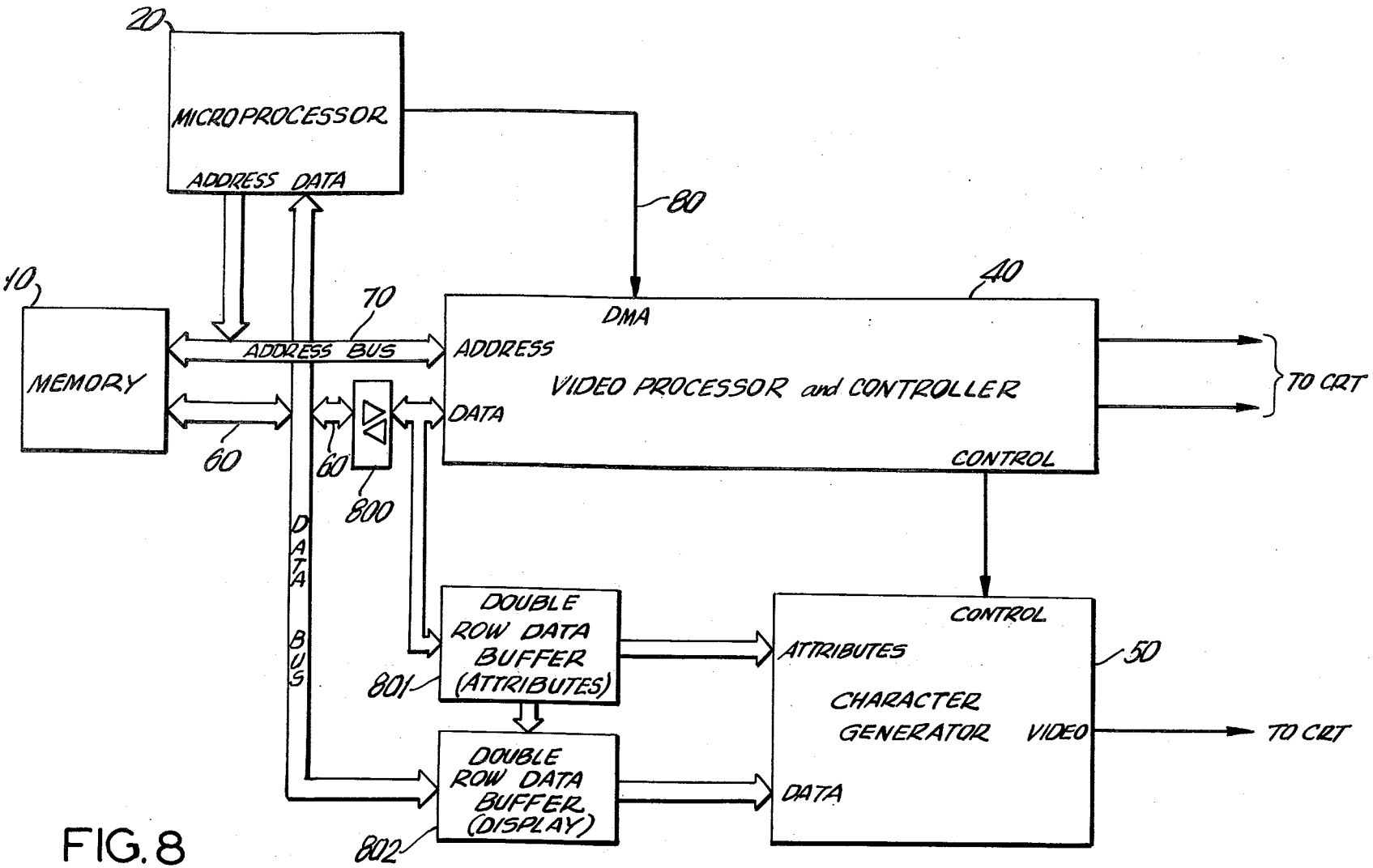
FIG. 8 illustrates a further embodiment of the video processor and controller of the instant invention.

Two modes of attribute assemble are possible and are illustrated in the embodiment of the invention shown in FIG. 8. In the first mode, data and attributes are stored in consecutive byte locations in memory as shown in FIG. 6. When the controller reads the addressed data location in memory (either by row table operations or by sequential addressing) the first byte read out by memory is considered an attribute which is loaded into an Internal Attribute Latch (not shown) in the controller. The controller then fetches the seconc byte in the display memory. This byte is the character byte associated with the attribute byte previously read out. During this same clock cycle, the controller isolates its bus from the main system bus via an external three-state buffer 800 as shown in FIG. 8 and outputs the attribute byte contained in the attribute latch to a double row data buffer 801. At the same time the main data bus which contains the ASCII character byte, is connected to a second double row data buffer 802. The two bytes of information (attribute and character) are loaded into their respective double row data buffers. The controller then accesses the next attribute and data byte and again loads them into the two double row data buffers. This process continues until the entire data row has been read out from memory and is assembled into the two double row buffers, 801 and 802.

At the next data row boundary, when it is time for the data row just assembled to be displayed, the data and attributes are read out simultaneously from the two data buffers thereby providing a full 16 bits for data and various associated attributes. In effect two bytes in memory located in sequential postions have been assembled and read out to the character generator and the video display as a single 16 bit word. This mode of operation requires that two bytes be associated with each character. Thus for an 80 character wide display there must be 160 bytes which are addressed for each data row.

Figure 7:
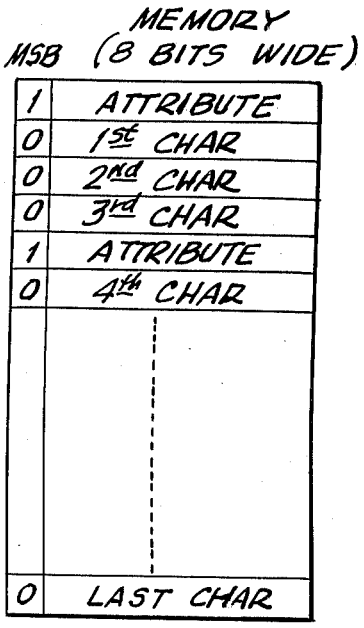

In the second operational mode for attribute assemble, attribute bytes are located in an 8-bit memory only where attributes are to change in the display as shown in FIG. 7. Thus if an entire word, for example, is to be underlined, an attribute byte will appear in memory just prior to that word's data bytes. This attribute byte will contain the appropriate attributes for the next word. However, it can only contain seven bits since the Most Significant Bit (MSB) is used for a special purpose as described below. ASCII data bytes may then follow this attribute byte in memory.

In operation, the controller reads each byte stored in memory and looks at the most significant bit to determine if it is an attribute byte or a data byte. If the MSB is one, it indicates an attribute byte. The attribute byte is brought into the Internal Attribute Latch in the controller and remains there until the next attribute byte is accessed. Whenever a data byte is read from memory, as indicated by its MSB being equal to a zero, both the data byte and its associated attribute in the attribute latch are written into two double row data buffers 801,802. This mode requires that the processor reserve only enough memory space necessary to accommodate the maximum number of attributes anticipated per data row. This is ordinarily less memory space than that occupied by the alternate attribute assemble mode which was described in the previous paragraph.

Double-Height/Double Width Data Rows

Registers 201 and 202 are used as left side and right side address registers, respectively, in this mode of operation. Both are 16 bit registers which contain a 14 bit memory address for the row table (previously described) plus two bits for row attributes. These two row attribute bits are encoded as follows:

00=normal height and normal width
01=normal height double width
10=double height double width-top
11=double height double width-bottom On a vertical split screen registers 201 and 202 must contain the same height and width mode bits.

When a double-height row is indicated by a "10" or a "11" code, the controller will increment scan line outputs every second horizontal scan line rather than every scan line. This causes the same scan line information to be read out from memory on two succeeding scan lines thereby effectively doubling the height of the data row. An internal address controller in the controller, continues to address memory as if it were addressing two ordinary data rows of memory; thus for a double-height row, a second row table memory address will be read out for the bottom half of the data row. The microprocessor must insure that the pointer for the bottom half points to the same data in memory as shown for the top half of the data row. In the sequential mode of addressing, the data of the top half of the data row must be duplicated in the memory read out during the bottom half of the data row.

Ordinarily, the bottom half of a double-height row is read out immediately following the top half of the double height row to give the appearance of a full double height row. However, for special effects certain system designers may wish to read out only the top half or only the bottom half of the data row. This may be done only with a double row data buffer configuration described above. In this case either a "10" or "11" bit pattern may be placed in the most significant bit positions of the row table pointer register to read out the top half or the bottom half of a double height row respectively.

The double-width data row mode is indicated by a "01", "10", or "11" code in the most significant bit positions of the row table pointer which is read out for each data row. In a double width data row, the address to display memory is changed every second character time so that the same data is addressed for two consecutive character times. This data is then presented (either with or without a buffer) to the external video character generator which then has the task of displaying each dot on the screen as a double width dot so that the character displayed takes up two normal width character position. An appropriate double width signal may be latched in an external flip-flop and used to condition the character generator for double width characters. Note that since the characters are double width, a data row that is normally 80 characters wide will only display the first 40 characters in that memory address space. The remainder will not be accessed by the controller.

Although a specific embodiment of this invention has been shown and described it will be understood that various modifications may be made without departing from the spirit of this invention.

We claim:

1. In a CRT video display system including a microprocessor, a memory, a video processor and controller, a data bus coupling said video processor and controller to said microprocessor and to said memory, and an address bus coupling said video processor and controller to said microprocessor and to said memory, said video processor and controller comprising a plurality of registers programmable by said microprocessor to store selected address characters and control characters, a first portion of said register plurality being connected to said data bus and a second portion of said register plurality being connected to said data bus and to said address bus, said memory containing information for a plurality of data rows, the information for each of said data rows being in the form of a plurality of bytes defining the characters for the data row and at least one preceding byte defining the starting address of the succeeding data row, said second portion of said register plurality including a start address register for defining a memory address to commence an addressing procedure, an address register, and logic and control means for retrieving from said memory said at least one succeeding-row address byte and for storing said at least one succeeding-row address byte in said address register until the time for displaying the succeeding data row, and means for accessing said registers via said address bus and said data bus and for utilizing said selected address characters and control characters stored in said registers.

2. The CRT video display system of claim 1, in which said data row information for each of said data rows further includes a second high-order byte preceding said plurality of character-defining bytes and with said at least one preceding byte defining the starting address of the succeeding data row, said system further comprising means for incrementing said video address register and to output the updated contents of said address register to said memory, thereby to retrieve said second high-order byte, and means for temporarily storing said second high-order byte along with said at least one succeeding-row byte in said address register until the time for displaying the subsequent data row.

3. The CRT video display system in accordance with claim 1, further comprising an address register/counter connected to the output of said auxiliary address register and to said address bus for incrementing the data row address information to said memory.

4. The CRT video display system in accordance with claim 1, further comprising a character generator controlled by said video processor and controller for displaying characters on said CRT in response to information retrieved from said memory.

5. The CRT video display system in accordance with claim 4, wherein each row of data displayed on said CRT comprises N scan lines of data, said video processor and controller further including means for retrieving from said memory a complete row of data during a first scan line interval and for storing said complete row in a data buffer and means for applying said complete row of data to said character generator during the remaining N-1 scan line intervals.

6. The CRT video display system in accordance with claim 5, wherein said video processor and controller further includes means for retrieving a first row of data from said memory during a vertical retrace interval and for storing said first row in said data buffer, means for applying said first row of data to said character generator during a first data row interval, and means for retrieving a second row of data from said memory and for storing said second row of data in said data buffer during said first data row interval.

7. The CRT video display system in accordance with claim 6, wherein said first and second data row retrieving means includes means for retrieving data rows from said memory in a continuous and repetitive sequence, said sequence comprising a predetermined retrieve interval followed by a predetermined delay interval, said retrieve interval being less than the time required to retrieve a complete row of data.

8. In a CRT video display system including a microprocessor, a memory, a video processor and controller, a data bus coupling said video processor and controller to said microprocessor and to said memory, and an address bus coupling said video processor and controller to said microprocessor and to said memory, said video processor and controller comprising a plurality of registers programmable by said microprocessor to store selected address characters and control characters, a first portion of said register plurality being connected to said data bus and a second portion of said register plurality being connected to said data bus and to said address bus, said memory containing information for a plurality of data rows, the information for each of said data rows being in the form of a plurality of bytes defining the characters for the data row and at least one preceding byte defining the starting address of the succeeding data row, said second portion of said register plurality including a start address register for defining a memory address to commence an addressing procedure, an address register, logic and control means for loading the memory address from said start address register into said address register, a video address register coupled to said address register and to said memory by said address bus, said logic and control means including means operable upon the start of a data row to load the address contained in said address register into said video address register and to output the contents of said video address register to said memory, thereby to retrieve said at least one succeeding-row address byte from said memory and to temporarily store the thus retrieved succeeding-row address byte in said address register until the time for displaying the succeeding data row, and means for accessing said programmable registers via said address bus and said data bus.

9. The CRT video display system of claim 8, in which said data row information for each of said data rows further includes a second high-order byte preceding said plurality of character-defining bytes and with said at least one preceding byte defining the starting address of the succeeding data row, said system further comprising means for incrementing said video address register and to output the updated contents of said address register to said memory, thereby to retrieve said second high-order byte, and means for temporarily storing said second high-order byte along with said at least one succeeding-row byte in said address register until the time for displaying the subsequent data row.

* * * * *